United States Patent [19]

Henderson

[11] Patent Number: 4,714,282

[45] Date of Patent: Dec. 22, 1987

[54] BLAST-RESISTANT DOOR LATCHING SYSTEM

[75] Inventor: Dale K. Henderson, Vienna, Va.

[73] Assignee: Temet, USA, Inc., Del.

[21] Appl. No.: 823,523

[22] Filed: Jan. 29, 1986

[51] Int. Cl.[4] ..... E05B 65/10

[52] U.S. Cl. ..... 292/36; 292/DIG. 22; 292/DIG. 65; 292/21; 292/244

[58] Field of Search ..... 292/1, DIG. 22, DIG. 65, 292/21, 36, 92, 244

[56] References Cited

U.S. PATENT DOCUMENTS 2,996,322 8/1961 McClellan ..... 292/36

3,088,548 5/1963 Behrens et al. ..... 292/36 X 3,990,531 11/1976 Register ..... 292/DIG. 22

3,993,335 11/1976 Schmidt ..... 292/21

*Primary Examiner*—Richard E. Moore

*Attorney, Agent, or Firm*—Iver P. Cooper

[57] ABSTRACT

A blast-resistant door latching system features independently attachable but interconnected inner panic bar and outer handle means for opening the door. The latches are biased to the closed position by a travel bar means. The latches are opened when the travel bar means is moved upward by intermediate linkages connecting it to the panic bar and the outer handle. Upward movement of the travel bar is blocked by an inertial stop means when a blast occurs.

6 Claims, 10 Drawing Figures

BLAST-RESISTANT DOOR LATCHING SYSTEM

FIELD OF THE INVENTION

This invention relates to a latching system for a blast door.

BACKGROUND OF THE INVENTION

Blast doors are required for blast-hardened structures such as military command centers, personnel shelters, explosives research control rooms, petroleum refinery control rooms, or ordnance assembly facilities or other applications in which doors may be exposed to explosive blasts. The doors allow entry into the protected space without breaching protection.

Blast doors must be able to withstand the initial blast overpressure, the force of the rebounding doorplate, and the explosion-induced ground shock. They should be fireproofed in accordance with National Fire Protection Association standards, which require "panic hardware" for opening the door and an automatic closer. It is also desirable that low force be required to operate the latch mechanism and to open and close the door, and that the latch mechanism be extremely reliable for many years.

Panic hardware for doors of public buildings are known. Symon, U.S. Pat. No. 4,488,378; Miller, U.S. Pat. No. 4,295,673; Ellingsen, U.S. Pat. No. 3,940,886; Godec, U.S. Pat. No. 4,167,280; Horgan U.S. Pat. No. 4,382,620. However, this panic hardware is not adapted for proper operation during and after an explosion. The overall scheme of a horizontal panic bar, a vertical travel bar actuator, and upper and lower latching means are conventional. Welch, U.S. Pat. No. 3,563,585. However, novel adaptations of this overall design were made here to provide blast door capability.

Independently operable inner handle releasing mechanisms are known. Eatinger, U.S. Pat. No. 2,948,561; Butterfield, U.S. Pat. No. 4,072,331. However, these references do not teach adaptation of such mechanisms for use in a blast-resistant latching system.

Biasing latch mechanisms toward a closed position is known. Lindquist, U.S. Pat. No. 4,429,909; Vodra, U.S. Pat. No. 4,545,606.

Gravity-actuated lock mechanisms are also known. Offen, U.S. Pat. No. 2,631,439; Smith, U.S. Pat. No. 3,642,314; Nagy, U.S. Pat. No. 3,778,933. However, no blast door having a latching system which is gravitationally biased toward the latched position by the weight of a latch activating-travel bar means is known.

Inertial lock mechanisms for car door locks are known. Leslie, U.S. Pat. No. 2,864,641; Lemaire, U.S. Pat. No. 3,066,964; Register, U.S. Pat. No. 3,990,531; Slavin, U.S. Pat. No. 4,422,522; Breitschwerdt, U.S. Pat. No. 3,719,248; Nozumu, U.S. Pat. No. 3,799,596; Davis, U.S. Pat. No. 4,007,557. However, the present invention is directed to a pivoting inertial stop which prevents a vertically moving travel bar means from causing the withdrawal of a latch bolt, said stop interposing itself only in response to blast forces.

"Handed" locks are known. Maurits, U.S. Pat. No. 3,499,789. However, the present invention is directed to a latching system in which all the essential elements may be used on either a left- or a right-swinging door.

SUMMARY OF THE INVENTION

This invention resides in a novel latching system for a blast door with interconnected push bar and pull handle door-opening means for unlatching gravitational biased latching means, and an inertial stop means which prevents actuation of the door-opening means by the force of a blast.

One object of the invention is to provide a latching system which will maintain the door closed in the event of a blast exerting a pressure of three atmospheres or more upon the door.

Another object of the invention is to provide a blast door latching system which can be opened by less than ten pounds of force exerted by an individual, or by a commercial door closing device.

Another object of the invention is to provide a blast door latching system having an inside panic bar means for unlatching and opening the door by a continuous pushing motion.

Another object of the invention is to provide a latching system having an outer handle assembly whereby the door is unlatched and opened by a continuous pulling action.

Another object of the invention is to provide a latching system in which the inside panic bar means may be used to unlatch the door even when the outer handle means is inoperable.

Another object of the invention is to provide a "slam-latch" latching system for a blast door.

Another object of the invention is to provide a latching system which is gravitationally biased toward the latched position.

Another object of the invention is to provide a latching system with an inertial stop means to prevent actuation of the unlatching mechanism by the rapid acceleration of the door against the inner handle assembly by the force of the blast.

Another object of the invention system is to provide a latching system in which the hinge is not required to bear a major part of the force of the blast.

Another object of the invention is to provide a blast door latching system which is not dependent on springs to bias the system toward the latched position.

Another object of the invention is to reduce manufacturing costs by providing a blast door latching system in which close tolerances are required in fewer locations.

Another object of the invention is to minimize the size of the bolts required to affix the latching system elements to the doorplate by placing the bolts as close as possible to the point of application of the rebound forces.

Another object of the invention is to provide a latching system which is independent of doorplate thickness except for bolt length and activator rod (15) length.

Another object of the invention is to provide a latching system in which the doorframe may be of any conventional outline provided that it is adapted to receive the latch bolts, and in which the door may be either surface- or recess-mounted.

Another object of the invention is to provide a blast door which can be unlatched and fully opened and then fully closed and latched within one minute. A one inch thick blast door with dimensions of 3 feet×6.5 feet, made of A36 structural steel plate, weight about 1200 pounds.

Other objects of the invention will be apparent after perusal of this specification.

DETAILED DESCRIPTION OF THE INVENTION

Figure 1:
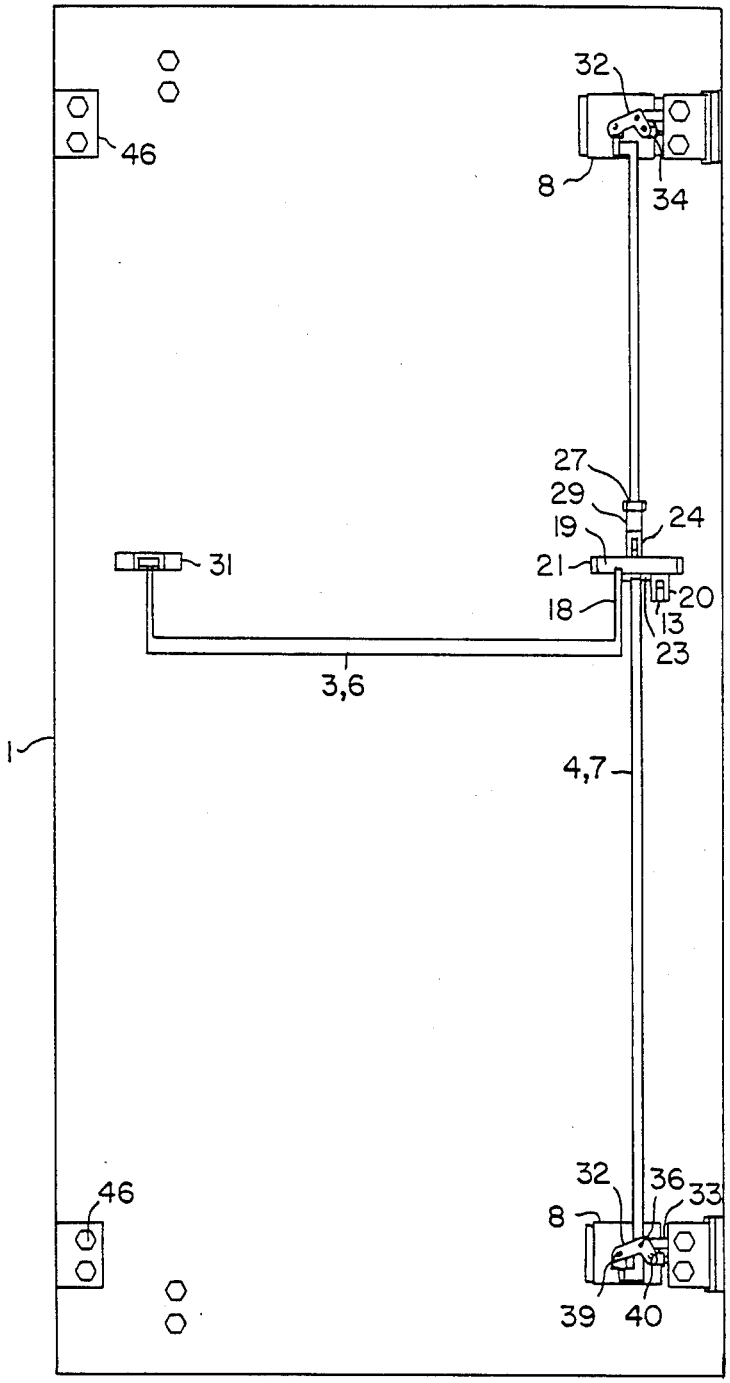
FIG. 1 shows a frontal view of the inside surface of the door with the latching system mounted (with covers removed).
Figure 2A:
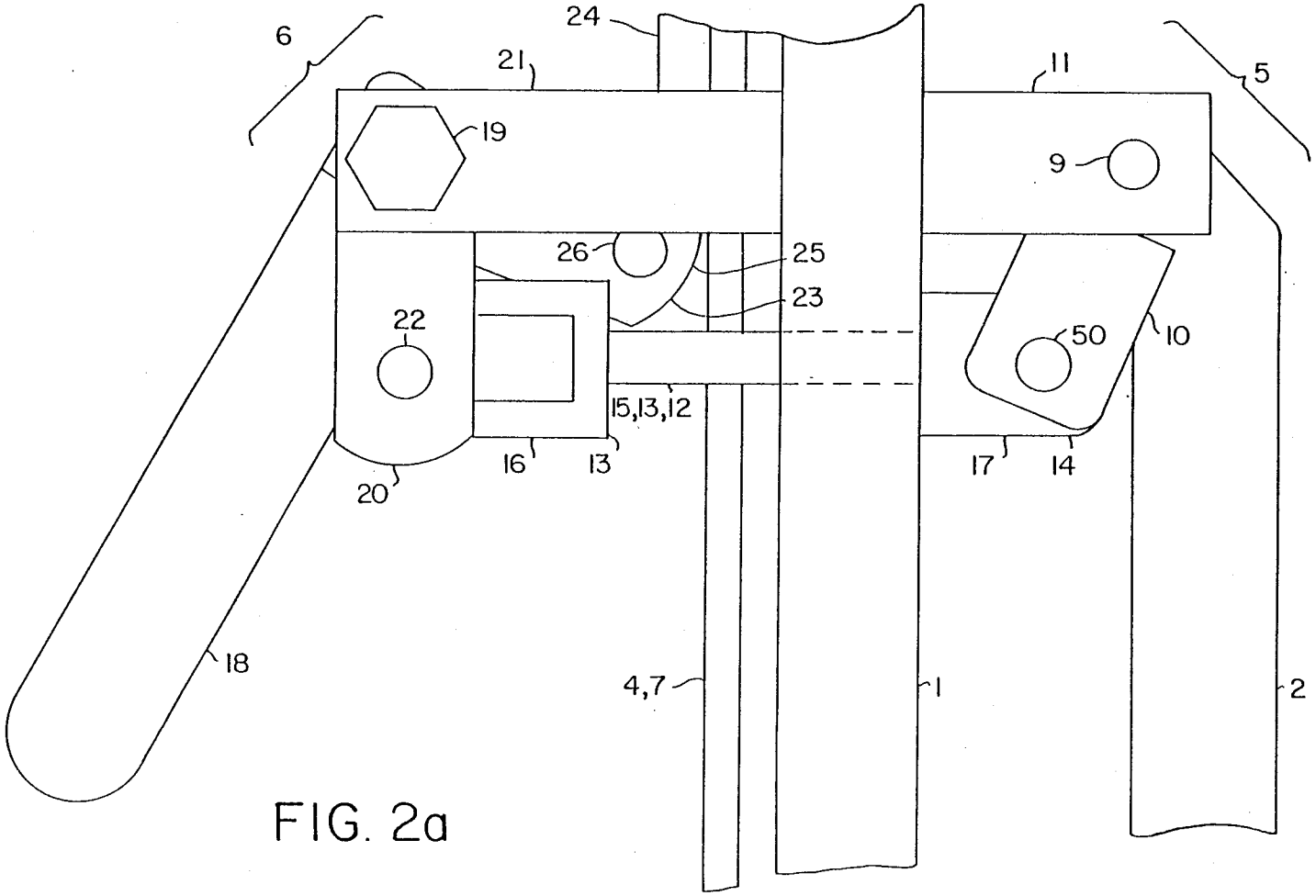
FIG. 2 shows profile views of the inner and outer handle subsystem. View (a) shows the mechanism in the closed position. View (b) shows the effect of pulling on the outer handle. View (c) shows the effect of pushing on the inner handle (panic bar).
Figure 2B:
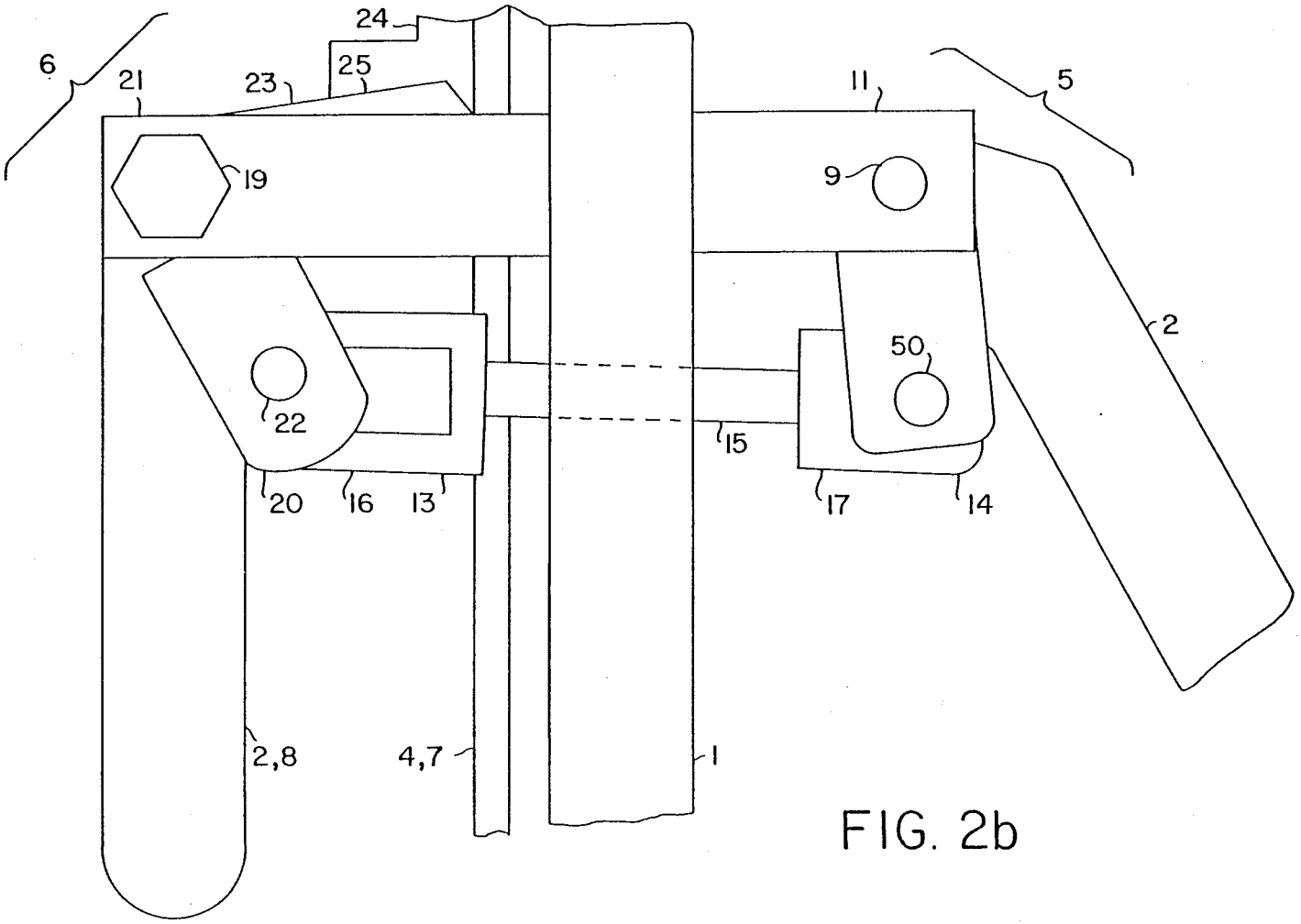
Figure 2C:
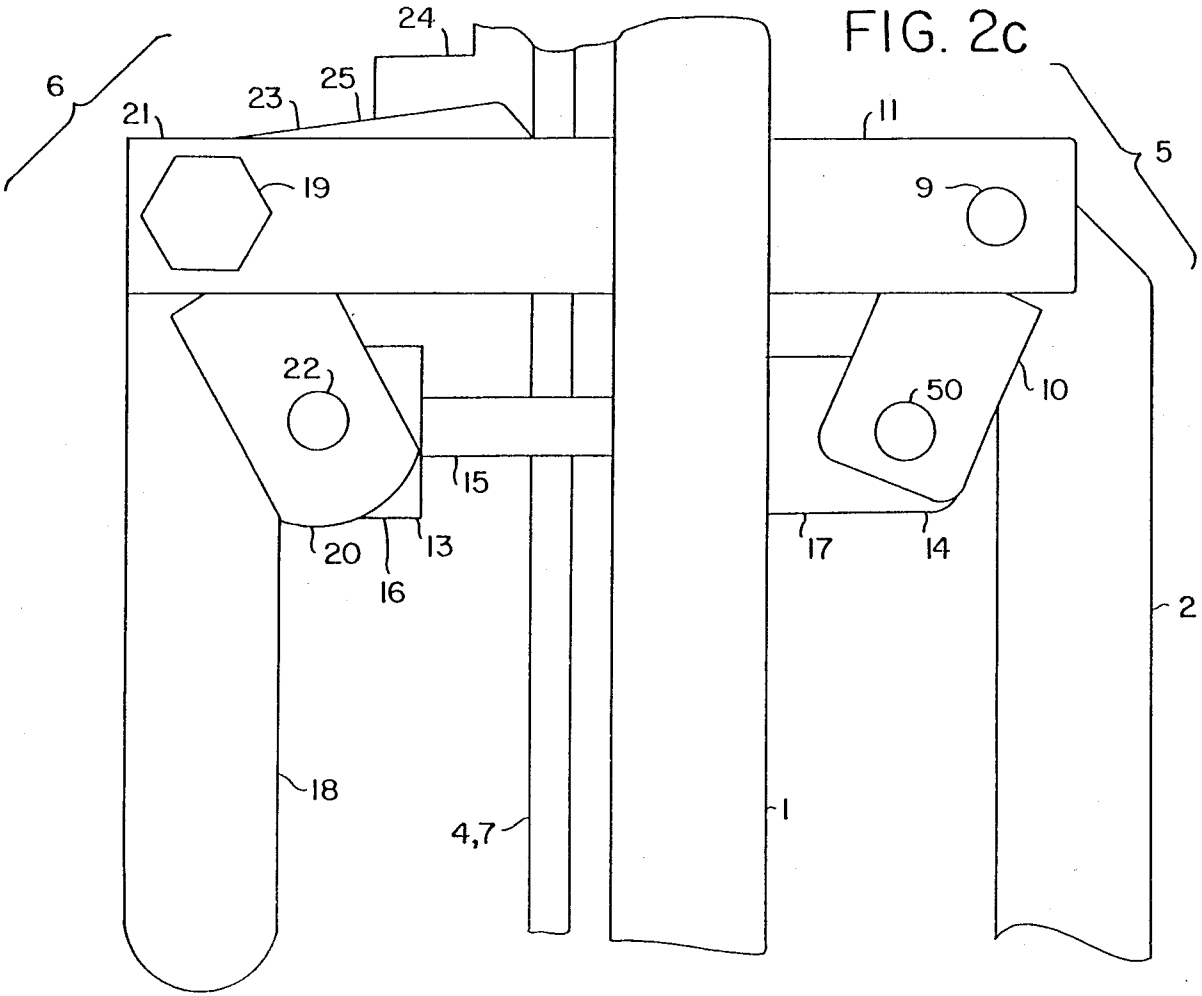
Figure 3A:
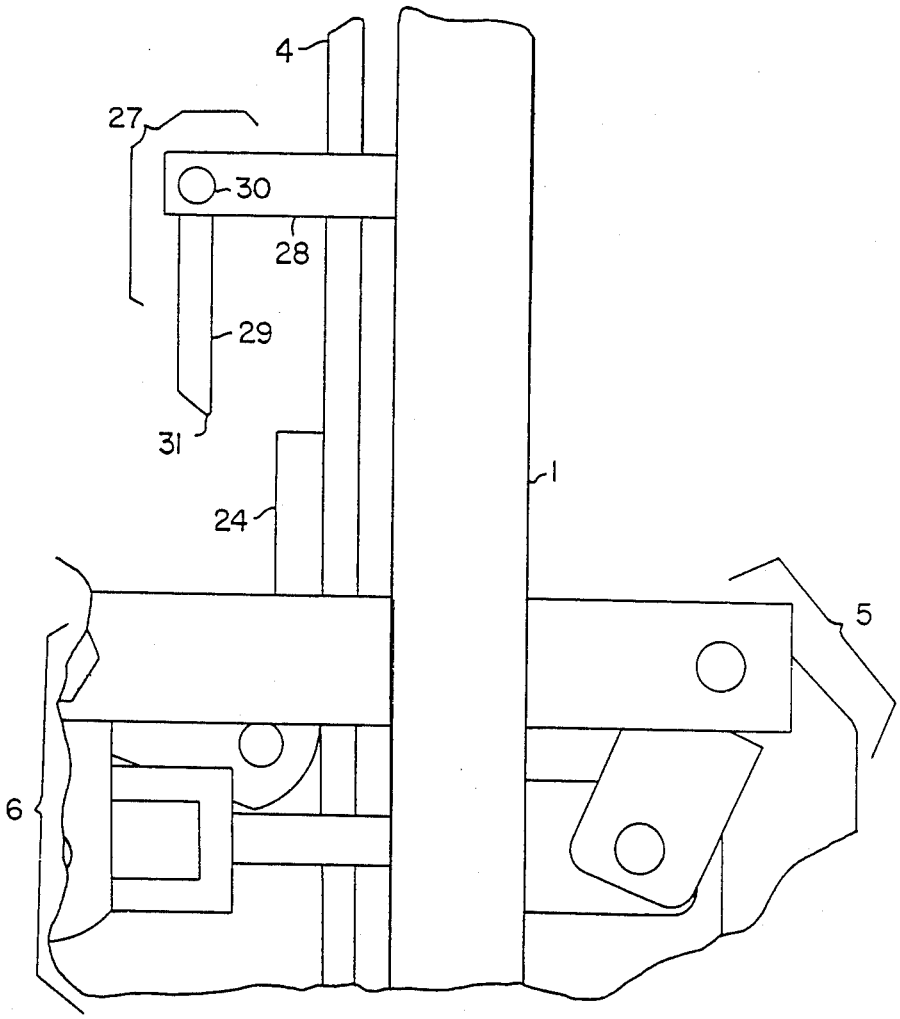
FIG. 3 shows profile views of the inertial stop subsystem. In view (a), the inertial stop and the travel bar are at rest. In view (b), the upward movement of the travel bar is blocked by the inertial stop. In view (c), the upward movement is unimpeded.
Figure 3B:
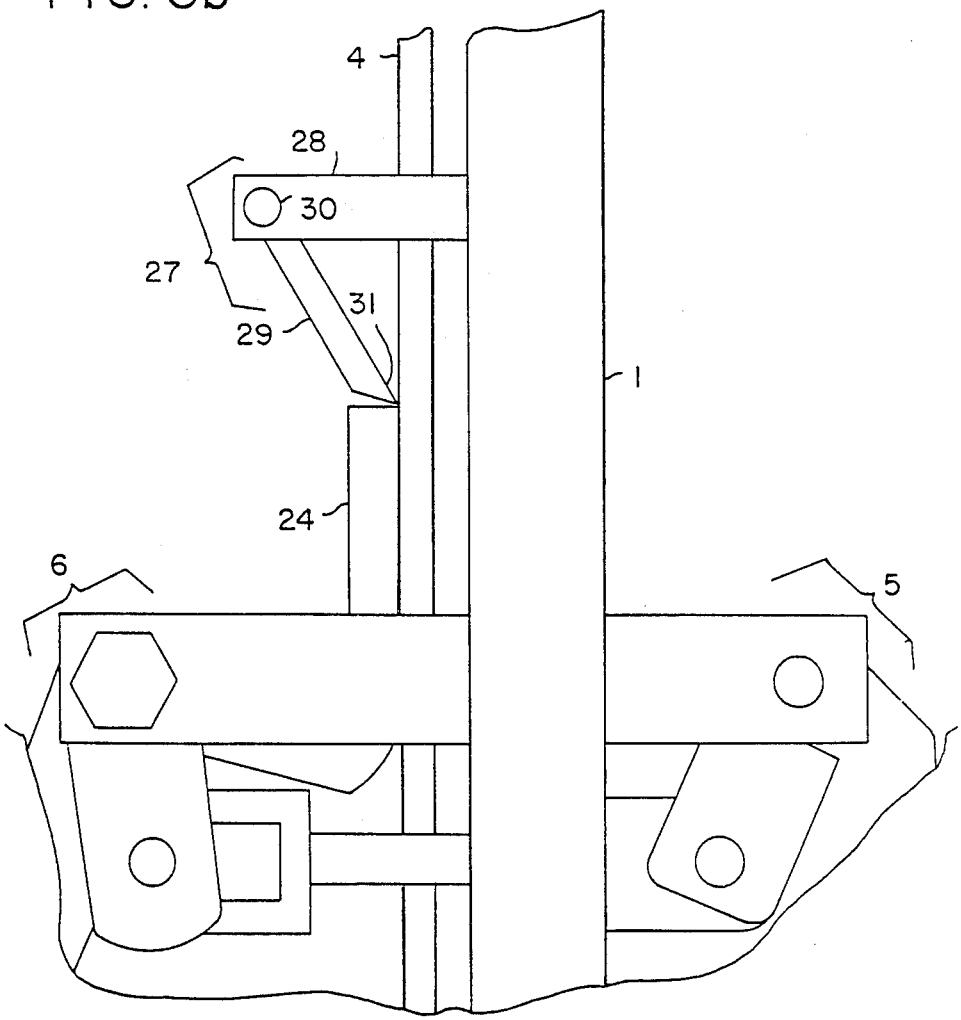
Figure 3C:
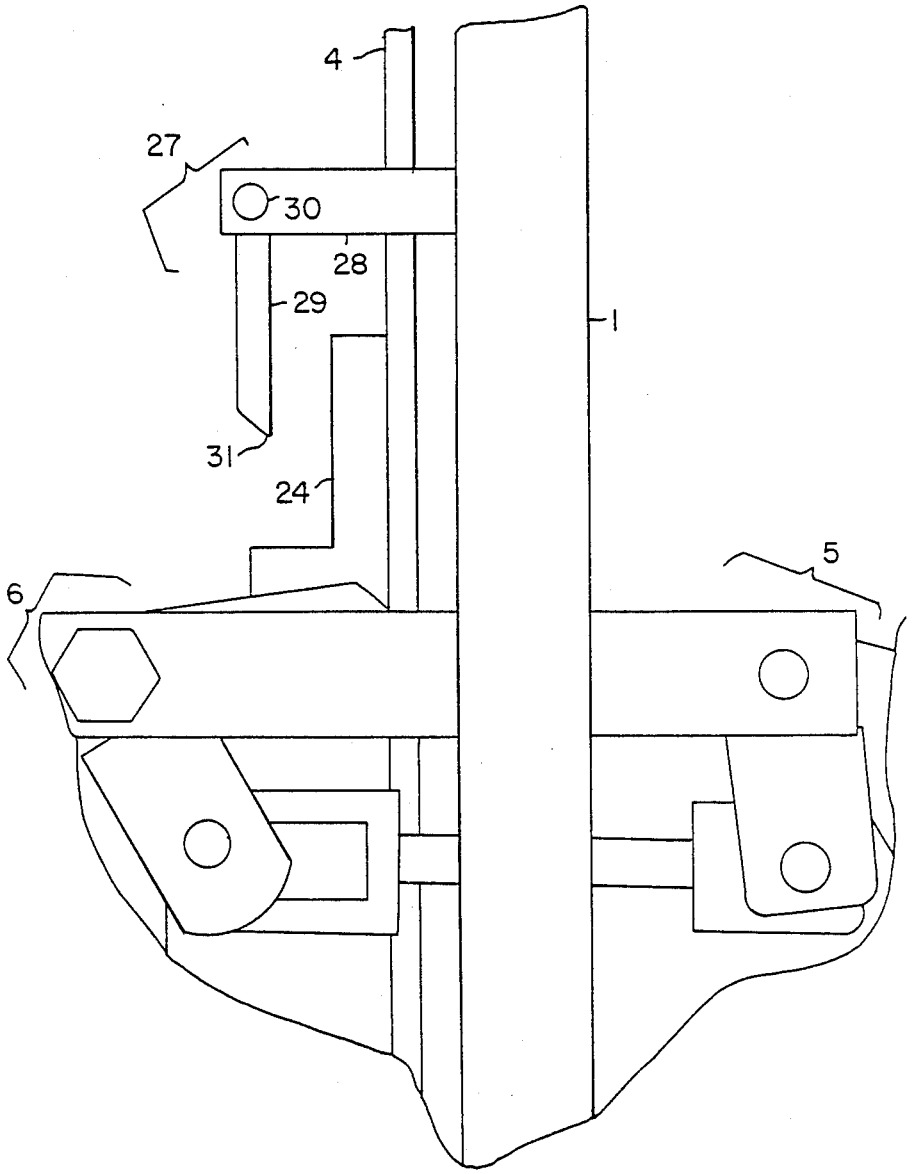
Figure 4A:
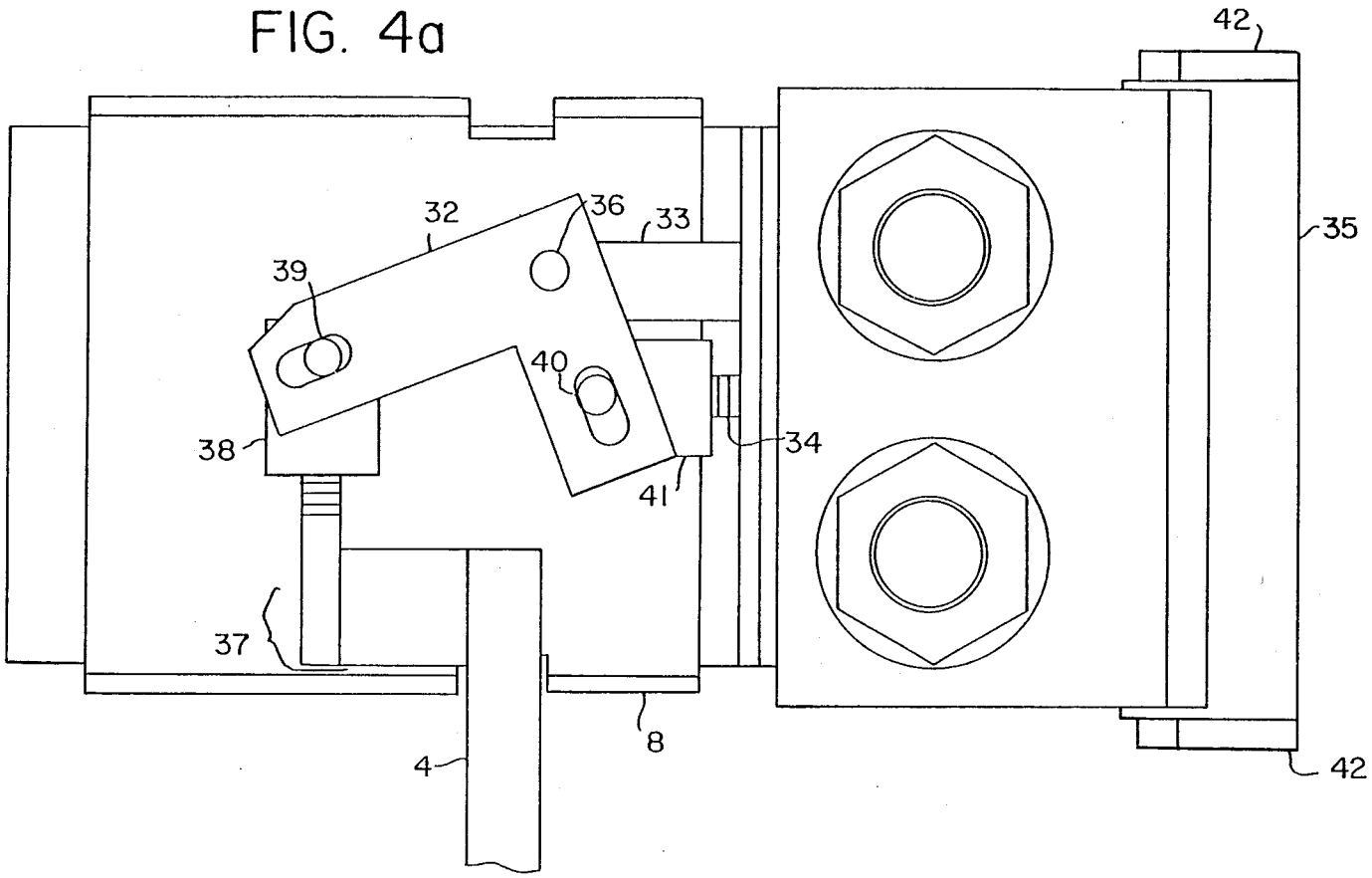
FIG. 4 shows frontal views of a moving latch. View (a) shows the rest (latched) position, and view (b), the actuated (unlatched) position.
Figure 4B:
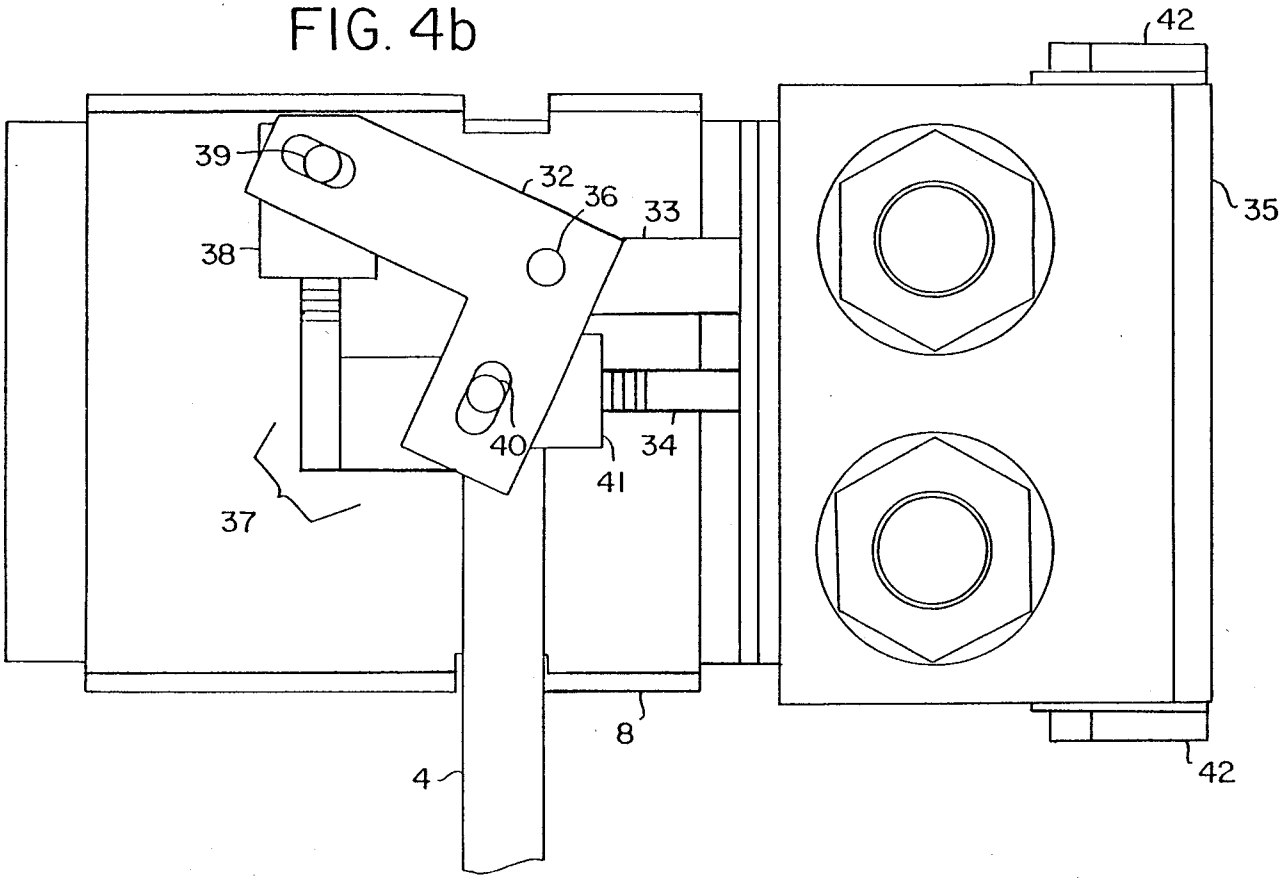
Figure 5:
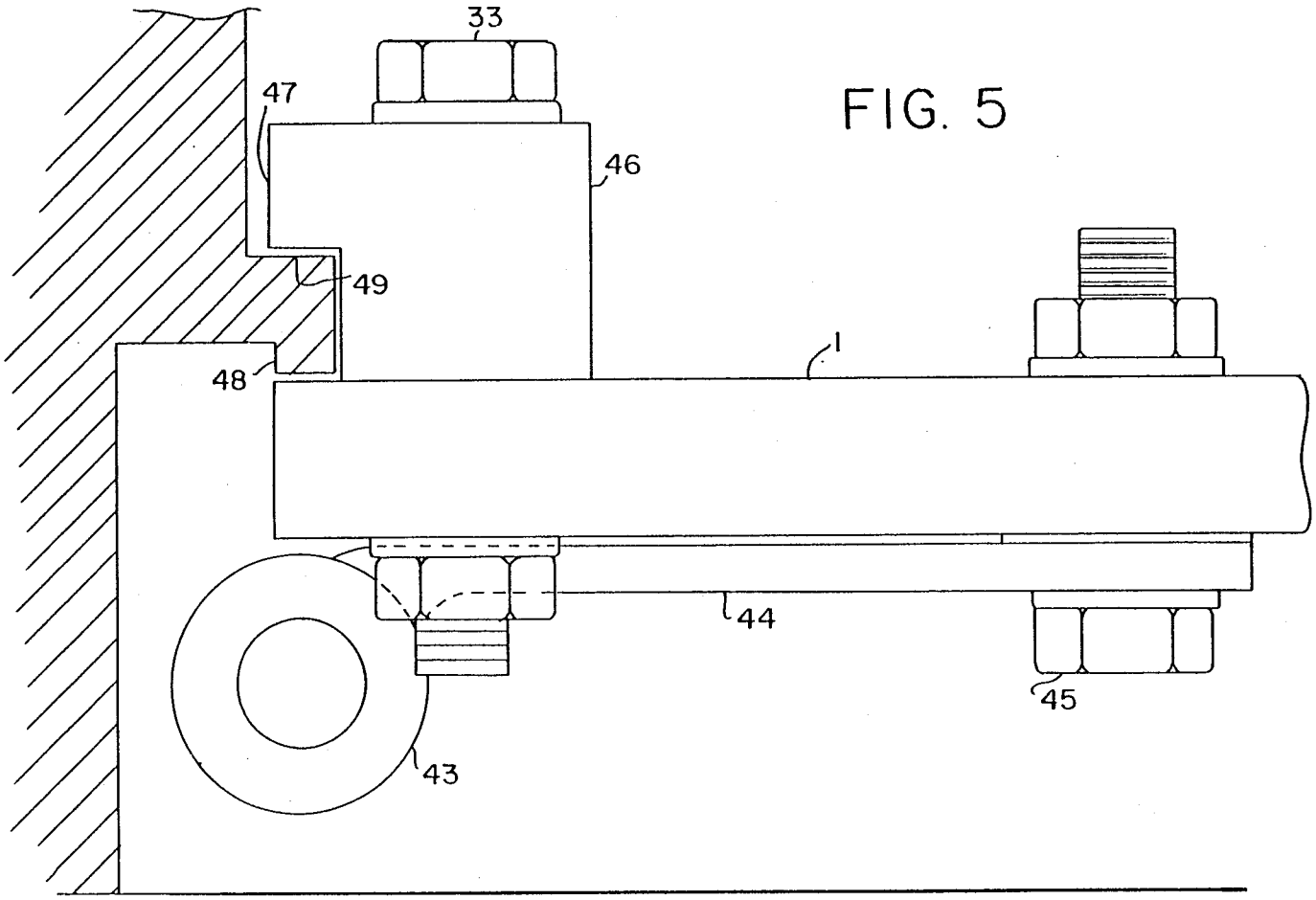
FIG. 5 shows a profile view of the hinge, journal arm, door plate, and stationary latch.

A blast wave is a high pressure sound wave generated by an explosion and lasting a few milliseconds. When the wavefront strikes the doorplate 1, the door plate deflects inward, and then rebounds. A blast door must be capable of withstanding both the initial positive blast pressure and the rebound force of the doorplate. The positive force is transferred from the doorplate to the pressure bead 48 and thence to the frame. The rebound force is transferred to the frame by the latching system. The preferred latching system comprises upper and lower moving latches on the swinging side and upper and lower stationary latches on the hinge side of the door. The latches engage suitable receiving means 49 in the frame. Preferably, each latch is capable of absorbing 50,000 pounds of force, for a total of 200,000 pounds of force. In practice the door may withstand about 640,000 pounds of force, since the force is not applied all at once.

The hinges may be designed solely to handle normal opening and closing forces, since the stationary latches 46 and the journal arm 44 absorb the blast wave on the hinged side. The journal arm absorbs only enough force to deflect, whereupon the stationary latches carry the remainder of the force.

A blast door must also be able to absorb ground shock induced by the blast. The ground shock moves the frame relative to the door. Lateral ground shock is absorbed by the aforementioned latches. The latches exert sufficiently clamping force to assure that the door is accelerated with the frame. Vertical ground shock may be absorbed by conventional shock blocks at the top and bottom, which likewise assure uniform acceleration of door and doorframe.

The door is unlatched from the outside by pulling on the outer handle 2, causing it to pivot outward; the continuation of the pulling action opens the door.

The door is unlatched from the inside by pushing on panic bar 3; the continuation of the pushing action opens the door.

A typical doorplate 1, weighs 1200 pounds. Preferably the door is mounted and the latching system is adjusted so that the door may be opened by only a few pounds of force. It is desirable that the upper hinge be exactly in alignment with the lower hinge so that the weight of the door does not exert a horizontal force component that would augment or oppose the opening action. With the hinges properly aligned, the door is opened when the frictional forces at the hinge and the inertia of the doorplate are overcome by the opening force applied on the handle.

With a push to give it momentum, the blast door will slam shut. Because the latching system is biased by the weight of travel bar 4 toward the latched position, the door will latch when fully closed. Prior art blast doors have required a separate step, such as the turning of a handwheel or the pivoting of a lever, to latch a shut door.

The basic elements of the latching system are the outer handle assembly 5, the inner panic bar assembly 6, the travel bar assembly 7, and the moving latch means 8. Pulling the outer handle 2 or pushing the panic bar 3 actuates the travel bar 4, which causes the moving latch means 8 to unlatch.

The outer handle assembly 5 comprises an outer axle 9, an outer handle 2, and an outer handle tab 10. The outer axle is mounted on outer handle bracket 11, which is rigidly connected to the doorplate 1, in such a manner that handle 2 may pivot about the axle 9. The tab 10 is also pivotedly connected to the axle 9, though angularly displaced from the handle 2. This tab means is connected to the handle activator means 12.

The handle activator means 12 comprises an inner activator means 13 and an outer activator means 14. The inner activator means comprises activator rod 15, which passes through the doorplate 1, and rectangular slot means 16. The outer end of the activator rod 15 is threaded to receive the C-shaped outer activator means 14, whose outer activator tabs 17 are bolted to outer handle tab 10 by activator bolt 50. The outward movement of the handle activator means 12 is constrained by the doorward edge of slot means 16, while inward movement is constrained by the doorward edge of the outer activator means 14. The activator rod 15 must of course by sufficiently longer than the thickness of the doorplate 1 to permit it to travel the desired activating distance.

The panic bar assembly 6 comprises an inner handle bar 18, inner handle axle 19, an inner activator tab means 20, and panic bar brackets 21. The handle bar 18 is pivotedly connected about axle 19 to brackets 21, which in turn are rigidly connected to the inner face of the doorplate 1. Tab means 20 is pivotedly connected to the inner handle axle 19. Tab means 20 bears pivot pin 22, which is disposed within slot 16 of inner activator means 13. A travel bar actuating tab means 23 is also pivotedly connected to the inner handle axle 19.

Preferably, the inner handle bar 18, the inner activator tab means 20, and the travel bar actuating tab means 23 are angularly disposed about the inner handle axle 19 so that the outside edge of the inner handle 3 is about six inches (15 cm) from the doorplate 1 when the latching system is in the fully closed position, and so that the inside edge of the inner handle 3 comes to about 1.5 inches (3.8 cm) from the door at the fully activated position. The inward pivoting movement of the inner handle bar 18 about the inner handle axle 19 is stopped when the inner actuator means 20 encounters the inner side of the panic bar bracket 21. This prevents the operator's fingers from being inadvertently caught between the inner handle bar and the doorplate.

Alternatively, other stop means could be provided on the handle itself to prevent mishap.

The travel bar 4 connects the moving latching means 8 with the actuating system. It is a continuous rod running vertically from the lower moving latch means 8'. When actuated, the travel bar 4 moves vertically upward about 1–1.25 inches to release the latches. When the handles are released, the travel bar 4 falls back to its rest position. A lift tab 24 is rigidly connected to the travel bar 4. The pivoting movement of the travel bar actuating means 23, and specifically lift piece 26 engages the lift tab 24 and causes the upward movement of the travel bar 4 in normal door-opening operation. The travel bar actuating means 23 preferably comprises a C-shaped piece 25 rigidly connected to the travel bar axle, and a lift piece 26 bridging the arms of the "C" which actually engaging the lift tab 24.

An inertial stop means 27 is disposed proximate to the rest position of lift tab 24. It comprises an inertial stop bracket 28, which is mounted on the doorplate 1, an inertial stop member 29, and an inertial stop axle 30. The axle 30 is connected to the inertial stop bracket 28. One end of the inertial stop 29 has an axle hole for receiving the axle 30, permitting the inertial stop to pivot about the axle. The other end 31 of the inertial stop is pointed, and the stop is mounted with the point closest to the doorplate 1.

The inertial stop means 27 is necessary to ensure closure when the door receives a blast. When the blast hits the door, the doorplate 1 moves relative to the handle 18. The effect is that the handle 18 pivots inward to the activated position, permitting the door to open on the rebound. This is clearly undesirable.

With the inertial stop means 27 present when a blast is received, the relative motion of the inertial stop 29 brings the pointed end 31 inward to block the upward movement of the lift tab 24 as a result of the relative motion of the actuating means 23. It is necessary to dispose the elements of the latch actuating system, and select their mass and length, so in case of blast, the inertial stop's pointed end 31 reaches the track of movement of the lift tab 21 during actuation before the lift tab, and (2) so in normal operation, the inertial stop does not flap into the track of the lift tab.

The cover for the handle mechanism preferably prevents the inertial stop from pivoting outward more than about 15 degrees. If unrestricted, the inertial stop may swing more than 180 deg. and come to rest in an ineffective position.

Each moving latch means 8 comprises a translator 32, a latch operator pivot arm 33, a latch operator rod 34, a latch bolt 35, and various latch pins 36.

The travel bar 4 has an anchor 37 which is pivotably connected through anchor yoke 38 to the translator 32 by movable pivot pin 39. The anchor yoke 38 is preferably threaded for purposes of adjustment. The translator 32 is pivotably connected to the latch operator pivot arm 33 by fixed pin 36. Finally, the translator is pivotably connected to latch yoke 41 by movable pivot pin 40. This latch yoke 41 is also preferably threaded for purposes of adjustment. The translator 32 is an essentially L-shaped piece which translates the upward movement of the travel bar 4 into horizontal, unlatching movement of the latch bolt 35. Yoke 41 is connected to the latch operator rod 34, which is threaded to receive the latch bolt 35. The latch bolt 35 has a return guide 42 with a sloped surface to provide a "slam latch" operation. As the door is closed, the door frame pushes away this sloped surface, permitting the latch to enter the latch receiving means of the doorframe. When the sloped surface has past, the latch is brought into the fully latched position by the frameward force exerted by the latch operator rod when the travel bar is allowed to respond freely to gravitational forces.

The upper and lower latch means are essentially identical.

On the hinged side, the hinge 43 is connected to the inner face of the door by journal arm 44. This arm is bolted to the door at a position 45 which is displaced $6\frac{5}{8}$ inches (16.5 cm) horizontally and several inches vertically from where it is welded to the hinge A clearance of 1/16 inch (0.16 cm) is left between the arm and the door to allow deflection of the journal arm.

The stationary latch means 46 is attached to the outer face of the door, also on the hinged side. The latch means has a tongue 47 which engages a suitable cavity in the door frame.

The force of the blast and rebound is dissipated by the deflection of the journal arm 44. The journal arm 44 is dimensioned to permit deflection. Thus, the length of the arm is preferably greater than or equal to 60 times the size of the gap between the door and the arm, or $60 \times 1/16 = 4$ inches (12 cm).

Upon the door being struck by a blast, or upon the rebound thereafter, the hinge 43 need only take enough blast or rebound force to initiate the deflection of the journal arm.

The journal arm deflects as the positive blast or rebound movement of the doorplate closes the original gap between the doorplate and the journal arm. When the gap is closed, the doorplate movement is stopped by the pressure bead or the stationary latches, respectively.

When one pulls on the outer handle 2, outer handle tab 10 pivots outward; causing outward movement of the outer activator means 14. By action of activator rod 15, this in turn causes doorward movement of the inner activator means 13. The pivot pin 22, which is disposed within slot means 16 at its lower, inner (i.e., away from the door) corner when at rest, is constrained to move doorward, causing a pivoting movement of the inner activator tab means 20 and thus of the travel bar actuating tab means 23. The travel bar actuating tab means 23 encounters lift tab 24 and causes it to move upward, thus raising the travel bar 4 to the moving latch-releasing position.

When one pushes on the panic bar 3, pivot pin 22 moves within slot means 16 from the lower outer corner to the upper inner corner, and then lifts and moves doorward the inner activator means 13 until it encounters the bracket 21. The pivoting movement of the panic bar also pivots upward the travel bar actuating tab means 23. It will be noted that the panic bar 3 may be used to activate the travel bar 4 even when the outside handle is jammed (through deformation by blast forces, or perhaps by a lock providing security) in the closed position.

It will also be recognized that the weight of the travel bar 4 acts to bias the moving latches 8 toward the latched position. It is conventional in the art to use springs to bias latches toward a closed position. However, springs are too unreliable for an application requiring a long operational life (twenty years and more) and continued operation after massive blast and/or ground shock. The gravitationally-biased latching system of the present invention is considerably more reliable.

The weight of the inner handle bar 18 exerts a torque about the inner handle bar axle 19 which applies an upward force to lift tab 24. The travel bar 4 must be heavy enough to overcome this upward force. By adjusting the relative masses and torques, the necessary opening force may be selected. This in turn permits the door assembly to be designed so it may be fully opened by a user, and then closed by a conventional pneumatic door closer, all within one minute. Typically, the door will be designed so the latching system is actuated by only ten pounds of force.

While use of only an upper pair and a lower pair of latches is described above, it will be evident that intermediate moving latches may be placed on the swinging side of the door and operated by travel bar 4. The number of stationary latches 46 should equal the number of moving latches 8, and each stationary latch should be at the same height as its opposing moving latch.

The description of the preferred embodiment provided herein is intended to exemplify and not to limit the invention.

LEGEND

| | | | |
|---|---|---|---|
| doorplate | 1 | inertial stop means | 27 |
| outer handle | 2 | inertial stop bracket | 28 |
| panic bar | 3 | inertial stop member | 29 |
| travel bar | 4 | inertial stop axle | 30 |
| outer handle assembly | 5 | pointed end | 31 |
| inner panic bar assembly | 6 | translator | 32 |
| travel bar assembly | 7 | latch operator pivot arm | 33 |
| moving latch means | 8 | latch operator rod | 34 |
| outer axle | 9 | latch bolt | 35 |
| outer handle tab | 10 | latch pin (fixed) | 36 |
| outer handle bracket | 11 | anchor | 37 |
| handle activator means | 12 | anchor yoke | 38 |
| inner activator means | 13 | latch pins (movable) | 39,40 |
| outer activator means | 14 | latch yoke | 41 |
| activator rod | 15 | return guide | 42 |
| slot means | 16 | hinge | 43 |
| outer activator tabs | 17 | journal arm | 44 |
| inner handle bar | 18 | journal arm bolts | 45 |
| inner handle axle | 19 | stationary latch means | 46 |
| inner activator tab means | 20 | tongue | 47 |
| panic bar brackets | 21 | pressure bead | 48 |
| pivot pin | 22 | receiving means | 49 |
| travel bar actuating tab means | 23 | activator bolt | 50 |
| lift tab | 24 | | |
| C-shaped bar tabs | 25 | | |
| lift piece | 26 | | |

I claim:

1. A blast door assembly comprising (a) a door having an outer side and an inner side;

(b) moving latch means disposed on said door and switchable between a door latching position and a door unlatching position;

(c) a vertically shiftable travel bar means operably connected to the moving latch means, and having an upper position in which the moving latch means unlatches the door and a lower position in which the moving latch means latches the door, said travel bar means gravitationally biassing said moving latch means toward the latched position;

(d) an inertial stop means acting to block the upward unlatching movement of said travel bar means in the event of a blast, but not interfering with unlatching during normal use of the door;

(e) outer handle means operably connected to the travel bar means for opening the door from the outside; and (f) inner panic bar means operably connected to the travel bar means for opening the door from the inside, said inner panic bar means being operable independently of said outer handle means.

2. The blast door assembly of claim 1, said latch means comprising a latch bolt means and a translator means, said travel bar means being operably connected to said latch bolt means by said translator means, for translating the vertical movement of the travel bar means into horizontal movement of the latch bolt means.

3. The blast door assembly of claim 1, said travel bar means having a lift tab actuator means, further comprising actuator pivot means to which the lift tab actuator means is pivotably connected, whereby the pivoting upward of the actuator means causes it to engage the lift tab means and thereby urge the travel bar means vertically upward, said inertial stop means comprising an inertial stop member, and pivot means rigidly connected to the door, the inertial stop member being pivotably connected to the pivot means, whereby in the event of a blast the inertial stop member pivots inward and blocks the upward movement of the lift tab means, while it does not block such movement when the door is subjected to ordinary opening or closing forces.

4. The blast door assembly of claim 1, further comprising stationary latch means disposed on the door opposite said moving latch means.

5. The blast door assembly of claim 1, further comprising handle actuating means operably connecting the outer handle means and the inner panic bar means to the travel bar means, said handle actuating means comprising an inner actuator having a rectangular slot, an outer actuator, and a moveable actuator rod rigidly connecting the inner actuator and the outer actuator, said door having a channel perpendicular to and connecting its inner and outer sides, said actuator rod being disposed in said channel so that the inner actuator lies near the inner side of the door and the outer actuator lies near the outer side of the door, said inner panic bar means having pivot pin means operably connecting it to the travel bar means, said pivot pin means also being pullably disposed in said slot, a door-opening manipulation of said outer handle means causing said handle actuating means to exert a pulling force on said pivot pin means by said outer actuator and thereby cause an upward movement of said travel bar means.

6. A blast door assembly comprising (a) a door;

(b) moving latch means disposed on said door and switchable between a door latching position and a door unlatching position;

(c) a vertically shiftable travel bar means operably connected to the moving latch means, and having an upper position in which the moving latch means unlatches the door and a lower position in which the moving latch means latches the door, said travel bar means gravitationally biassing said moving latch means toward the latched position; and (d) an inertial stop means acting to block the upward unlatching movement of said travel bar means in the event of a blast, said inertial stop means comprising an inertial stop member and a pivot means rigidly connected to the door, the inertial stop member being pivotably connected to the pivot means, whereby in the event of a blast the inertial stop member pivots and blocks the upward movement of the travel bar means, while it does not block such movement when the door is subjected to ordinary opening or closing forces.

* * * * *